US009538780B1

(12) United States Patent
Deroo et al.

(10) Patent No.: US 9,538,780 B1
(45) Date of Patent: Jan. 10, 2017

(54) CHEWING TOBACCO PROTECTIVE BARRIER SYSTEM

(71) Applicants: Jordan Deroo, Platteville, CO (US); Bryce Deroo, Platteville, CO (US)

(72) Inventors: Jordan Deroo, Platteville, CO (US); Bryce Deroo, Platteville, CO (US)

( * ) Notice: Subject to any disclaimer, the term of this patent is extended or adjusted under 35 U.S.C. 154(b) by 619 days.

(21) Appl. No.: 13/934,923

(22) Filed: Jul. 3, 2013

(51) Int. Cl.
*A61C 5/14* (2006.01)
*A24B 13/00* (2006.01)
*A63B 71/08* (2006.01)

(52) U.S. Cl.
CPC ..... *A24B 13/00* (2013.01); *A61C 5/14* (2013.01); *A63B 71/085* (2013.01)

(58) Field of Classification Search
CPC ..... A63B 71/085; A61C 5/14
USPC ..... 128/859, 861
See application file for complete search history.

(56) References Cited

U.S. PATENT DOCUMENTS 1,005,981 A * 10/1911 Keenan ..... A24D 1/042 131/361
2,706,478 A 4/1955 Porter
3,379,193 A 4/1968 Monaghan
3,924,638 A 12/1975 Mann
6,162,516 A * 12/2000 Derr ..... A24B 13/00 131/271
7,047,978 B2 5/2006 Zuk
7,832,404 B2 11/2010 Jansheski
2003/0027888 A1* 2/2003 Ashman ..... A61C 8/0006 523/120
2006/0070630 A1 4/2006 Giannoni
2006/0099551 A1* 5/2006 Feldman ..... A61C 5/00 433/215
2007/0009856 A1 1/2007 Jones et al.
2009/0165805 A1 7/2009 Syrop et al.
2011/0088703 A1* 4/2011 Ambis, Jr. ..... A63B 71/085 128/861
2011/0139162 A1 6/2011 Chodorow
2011/0186055 A1 8/2011 Makkar et al.

* cited by examiner

*Primary Examiner* — Michael H Wilson
*Assistant Examiner* — Eric Yaary

(57) ABSTRACT

The present invention features a system for providing a protective barrier between a portion of chewing tobacco and a gum surface of a user. The system features a set of bottom teeth located in a mouth of a user. The system features a portion of chewing tobacco. The system features a barrier having a planar barrier anterior wing and a planar barrier posterior wing. The barrier anterior wing features a shape of a rectangle. The barrier posterior wing features a shape of an isosceles trapezoid. A top anterior wing edge is foldably located on a top posterior wing edge forming a cross section of a "V". The barrier features a wax coating on a front anterior wing surface and a rear posterior wing surface.

4 Claims, 3 Drawing Sheets

CHEWING TOBACCO PROTECTIVE BARRIER SYSTEM

FIELD OF THE INVENTION

The present invention relates to mouth protection systems or more specifically mouth protection systems for use with chewing tobacco.

BACKGROUND OF THE INVENTION

Chewing tobacco has been used for hundreds of years. Although it is enjoyed by many, there are health issues associated with its use. The present invention features a system for providing a protective barrier between a portion of chewing tobacco and a gum surface of a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a system for providing a protective barrier between a portion of chewing tobacco and a gum surface of a user. In some embodiments, the system comprises a set of bottom teeth located in a mouth of a user. In some embodiments, the system comprises a portion of chewing tobacco. In some embodiments, the system comprises a barrier having a planar barrier anterior wing and a planar barrier posterior wing.

In some embodiments, the barrier anterior wing comprises a shape of a rectangle. In some embodiments, the barrier posterior wing comprises a shape of an isosceles trapezoid. In some embodiments, a top anterior wing edge is foldably located on a top posterior wing edge forming a cross section of a "V". In some embodiments, the barrier comprises a wax coating on the front anterior wing surface and the rear posterior wing surface.

DESCRIPTION OF PREFERRED EMBODIMENTS

Following is a list of elements corresponding to a particular element referred to herein:

100 Chewing tobacco protective barrier system
110 Tooth
111 Tooth front surface
112 Tooth rear surface
113 Tooth top edge
114 Gum surface

Figure 1:
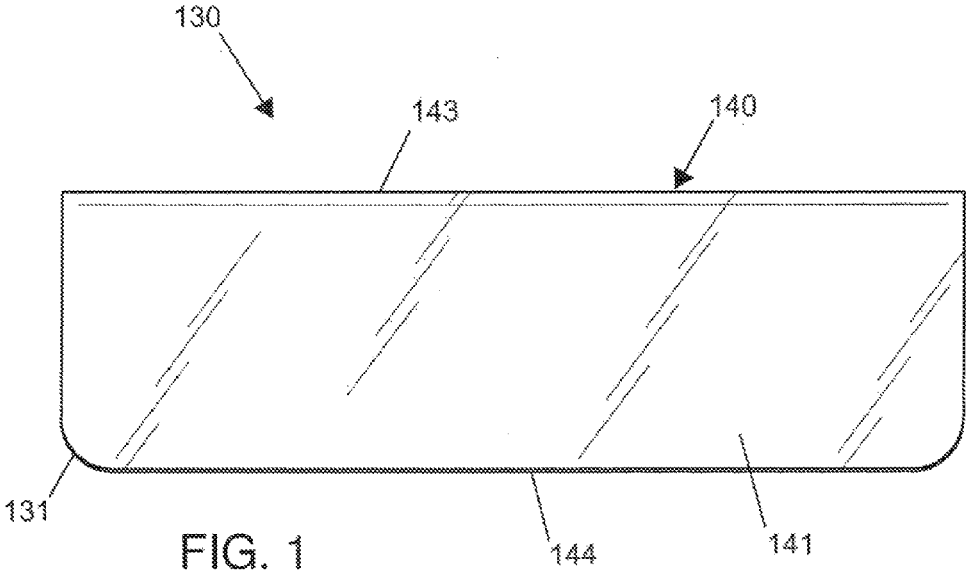
FIG. 1 shows a front view of the barrier of the present invention.
Figure 2:
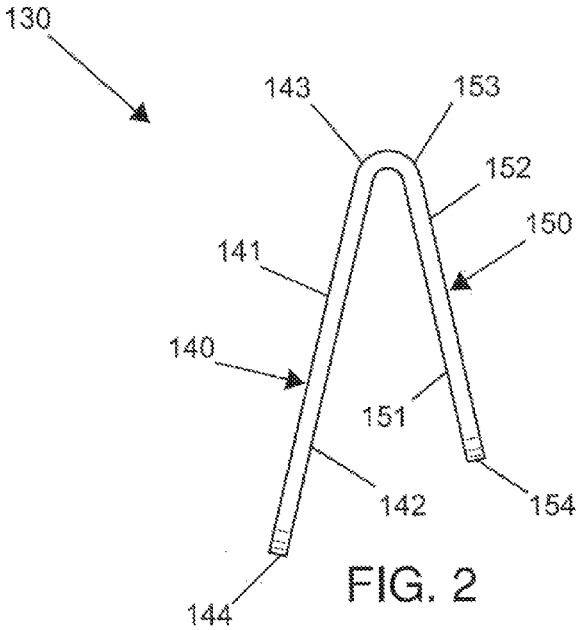
FIG. 2 shows a side view of the barrier of the present invention.
Figure 3:
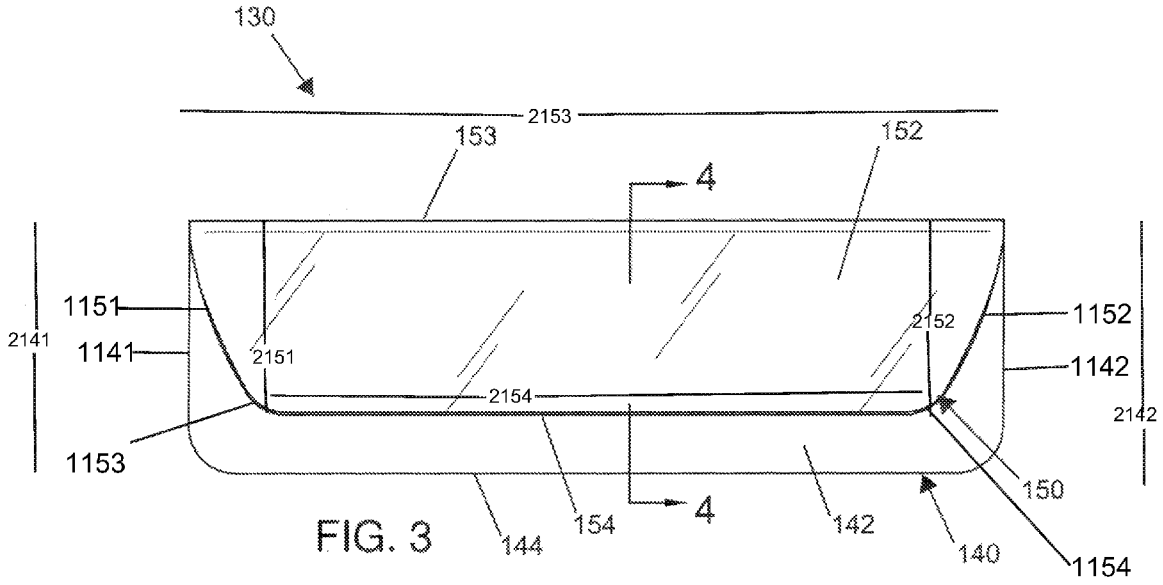
FIG. 3 shows a rear view of the barrier of the present invention.
Figure 4:
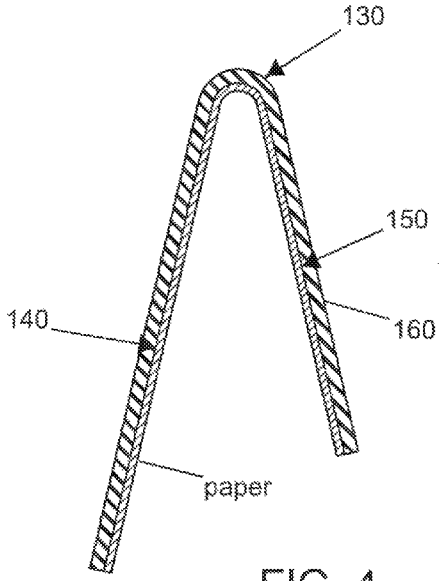
FIG. 4 shows a cross-sectional view of the barrier of the present invention.
Figure 5:
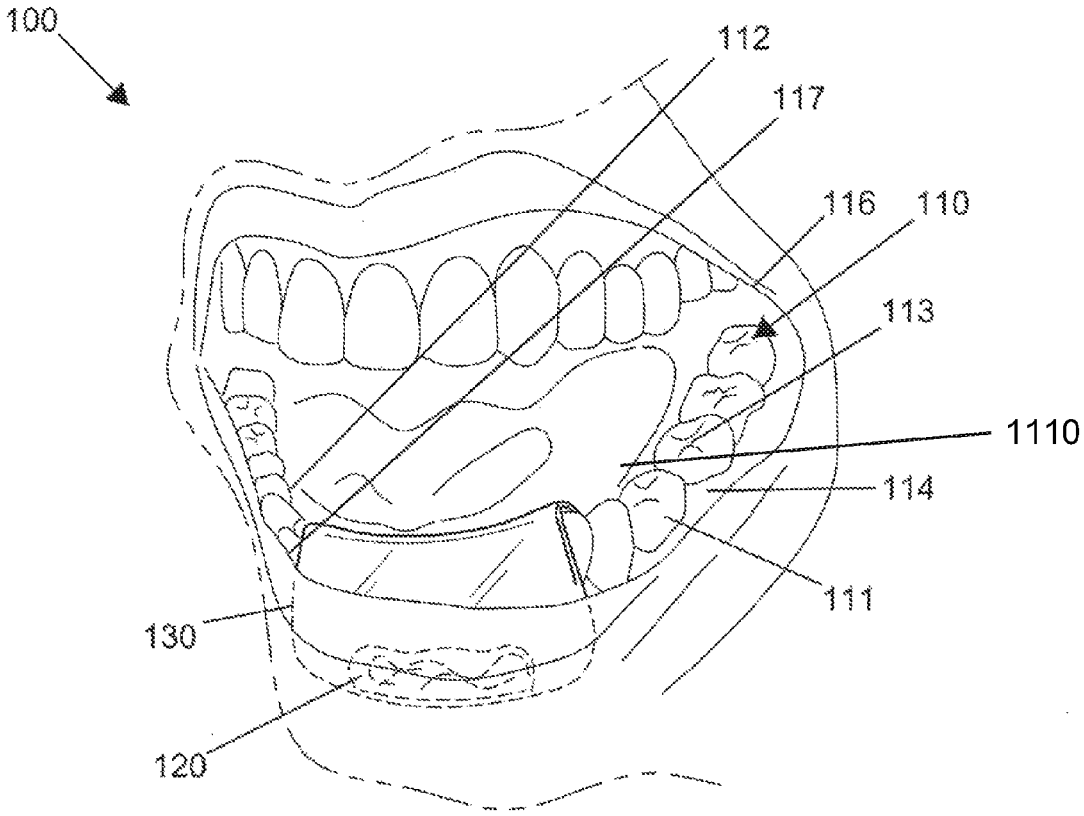
FIG. 5 shows the present invention in use.

116 Mouth
117 Cheek inside surface
120 Chewing tobacco
130 Barrier
131 Corner
140 Barrier anterior wing
141 Front anterior wing surface
142 Rear anterior wing surface
143 Top anterior wing edge
144 Bottom anterior wing edge
150 Barrier posterior wing
151 Front posterior wing surface
152 Rear posterior wing surface
153 Top posterior wing edge
154 Bottom posterior wing edge
160 Wax coating Referring now to FIG. 1-5, the present invention features a chewing tobacco protective barrier system (100) for providing a protective barrier between a portion of chewing tobacco and a gum surface of a user. In some embodiments, the system (100) comprises a set of bottom teeth (110) located in a mouth (116) of a user. In some embodiments, the system (100) comprises a portion of chewing tobacco (120). In some embodiments, the system (100) comprises a barrier (130) having a planar barrier anterior wing (140) and a planar barrier posterior wing (150).

In some embodiments, the barrier anterior wing (140) comprises a front anterior wing surface (141), a rear anterior wing surface (142), a top anterior wing edge (143), and an opposing bottom anterior wing edge (144). In some embodiments, the barrier anterior wing (140) comprises a shape of a rectangle having the top anterior wing edge (143) and the bottom anterior wing edge (144) as the longest edges. In some embodiments, the top anterior wing edge (143) and the bottom anterior wing edge (144) are parallel to one another.

In some embodiments, the barrier posterior wing (150) comprises a front posterior wing surface (151), a rear posterior wing surface (152), a top posterior wing edge (153), and an opposing bottom posterior wing edge (154). In some embodiments, the barrier posterior wing (150) comprises a shape of an isosceles trapezoid having the top posterior wing edge (153) as the longest edge. In some embodiments, the top posterior wing edge (153) is parallel to the bottom posterior wing edge (154). In some embodiments the barrier posterior wing (150) comprises a first posterior wing side and an opposing second posterior wing side. In some embodiments, the first posterior wing side and the second posterior wing side comprise a shape of an arc. In some embodiments, a corner where the first posterior wing side intersects the bottom posterior wing edge (154) is rounded. In some embodiments, a corner where the second posterior wing side intersects the bottom posterior wing edge (154) is rounded. In some embodiments, a length of the top posterior wing edge (153) is equal to a length of the top anterior wing edge (143). In some embodiments, a length of the bottom posterior wing edge (154) is less than the length of the top posterior wing edge (153). In some embodiments, a length of the bottom posterior wing edge (154) is less than a length of the bottom anterior wing edge (144).

In some embodiments, the top anterior wing edge (143) is continually attached and foldably hinged on the top posterior wing edge (153). In some embodiments, the barrier forms a cross-section of a "V" in a sagittal plane.

In some embodiments, the barrier (130) comprises a wax coating (160) on the front anterior wing surface (141) and the rear posterior wing surface (152).

In some embodiments, the barrier (130) comprises rounded corners (131) located thereon.

In some embodiments, the barrier (130) is constructed from rice paper. In some embodiments, the barrier (130) is constructed from paper. In some embodiments, the barrier (130) is constructed from plastic. In some embodiments, the barrier (130) is constructed from metal.

In some embodiments, a method for protecting a gum surface of a user while chewing tobacco using a chewing tobacco protective barrier system (100) comprises obtaining a portion of chewing tobacco (120).

In some embodiments, the method comprises obtaining a barrier (130) having a planar barrier anterior wing (140) and a planar barrier posterior wing (150). In some embodiments, the barrier anterior wing (140) comprises a front anterior wing surface (141), a rear anterior wing surface (142), a top anterior wing edge (143), and an opposing bottom anterior wing edge (144). In some embodiments, the barrier anterior wing (140) comprises a shape of a rectangle having the top anterior wing edge (143) and the bottom anterior wing edge (144) as the longest edges. In some embodiments, the top anterior wing edge (143) and the bottom anterior wing edge (144) are parallel to one another.

In some embodiments, the barrier posterior wing (150) comprises a front posterior wing surface (151), a rear posterior wing surface (152), a top posterior wing edge (153), and an opposing bottom posterior wing edge (154). In some embodiments, the barrier posterior wing (150) comprises a shape of an isosceles trapezoid having the top posterior wing edge (153) as the longest edge. In some embodiments, the top posterior wing edge (153) is parallel to the bottom posterior wing edge (154). In some embodiments, the top anterior wing edge (143) is continually attached and foldably hinged on the top posterior wing edge (153). In some embodiments, the barrier forms a cross-section of a "V" in a sagittal plane. In some embodiments, the barrier (130) comprises a wax coating (160) on the front anterior wing surface (141) and the rear posterior wing surface (152).

In some embodiments, the method comprises inserting the barrier (130) into a mouth (116) of a user over a set of bottom teeth (110). In some embodiments, the rear anterior wing surface (142) interfaces with a set of bottom teeth front surface (111). In some embodiments, the front posterior wing surface (151) interfaces with a set of bottom teeth rear surface (112). In some embodiments, the bottom anterior wing edge (144) interfaces with an intersection of a bottom front gum surface (114) and a cheek inside surface (117). In some embodiments, an inside surface of an intersection of the top anterior wing edge (143) and the top posterior wing edge (153) interfaces with a set of bottom teeth top edge (113).

In some embodiments, the method comprises inserting the chewing tobacco (120) into the mouth (116) of the user. In some embodiments, the chewing tobacco (120) is placed between the front anterior wing surface (141) and the cheek inside surface (117) for use.

As used herein, the term "about" refers to plus or minus 10% of the referenced number.

The disclosures of the following U.S. Patents are incorporated in their entirety by reference herein: U.S. Patent Pub. No. 2011/0186055; U.S. Patent Pub. No. 2011/0139162; U.S. Patent Pub. No. 2009/0165805; U.S. Patent Pub. No. 2007/0009856; U.S. Patent Pub. No. 2006/0070630; U.S. Pat. No. 7,832,404; U.S. Pat. No. 7,047,978; U.S. Pat. No. 3,924,638; U.S. Pat. No. 3,379,193; and U.S. Pat. No. 2,706,478.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A chewing tobacco protective barrier system (100) for providing a protective barrier between a portion of chewing tobacco and a gum surface of a user, wherein the system (100) comprises:

(a) a portion of chewing tobacco (120); and (b) a barrier (130) having a planar barrier anterior wing (140) and a planar barrier posterior wing (150), wherein the barrier covers only front lower teeth of the user, wherein the barrier anterior wing (140) comprises a front anterior wing surface (141), a rear anterior wing surface (142), a top anterior wing edge (143), and an opposing bottom anterior wing edge (144), wherein the barrier anterior wing (140) comprises a shape of a rectangle having the top anterior wing edge (143) and the bottom anterior wing edge (144) as the longest edges, wherein the top anterior wing edge (143) and the bottom anterior wing edge (144) are parallel to one another, wherein the barrier posterior wing (150) comprises a front posterior wing surface (151), a rear posterior wing surface (152), a top posterior wing edge (153), and an opposing bottom posterior wing edge (154), wherein the barrier posterior wing (150) comprises a shape of an isosceles trapezoid having the top posterior wing edge (153) as the longest edge, wherein the top posterior wing edge (153) is parallel to the bottom posterior wing edge (154), wherein the barrier posterior wing (150) comprises a first posterior wing side (1151) and an opposing second posterior wing side (1152) which taper toward sides in a form of an arc; wherein a length (2154) of the bottom posterior wing edge (154) is less than a length (2153) of the top posterior wing edge (153); wherein a height (2151) of the first posterior wing side (1151) is less than a height (2141) of a first anterior wing side (1141) and a height (2152) of the second posterior wing side (1152) is less than a height (2142) of a second anterior wing side side (1142); wherein a first corner (1153) is rounded where the first posterior wing side (1151) intersects the bottom posterior wing edge (154), wherein a second corner (1154) is rounded where the second posterior wing side (1152) intersects the bottom posterior wing edge (154);

wherein the top anterior wing edge (143) is continually attached and foldably disposed on the top posterior wing edge (153), wherein the barrier forms a cross-section of a "V" in a sagittal plane, wherein the barrier (130) comprises a wax coating (160) on the front anterior wing surface (141) and the rear posterior wing surface (152).

2. The system (100) of claim 1, wherein the barrier (130) is constructed from rice paper.

3. A method for protecting a gum surface of a user while chewing tobacco using a chewing tobacco protective barrier system (100), wherein the method comprises:

(a) obtaining a portion of chewing tobacco (120);

(b) obtaining a barrier (130) having a planar barrier anterior wing (140) and a planar barrier posterior wing (150), wherein the barrier covers only front lower teeth of the user, wherein the barrier anterior wing (140) comprises a front anterior wing surface (141), a rear anterior wing surface (142), a top anterior wing edge (143), and an opposing bottom anterior wing edge (144), wherein the barrier anterior wing (140) comprises a shape of a rectangle having the top anterior wing edge (143) and the bottom anterior wing edge (144) as the longest edges, wherein the top anterior wing edge (143) and the bottom anterior wing edge (144) are parallel to one another, wherein the barrier posterior wing (150) comprises a front posterior wing surface (151), a rear posterior wing surface (152), a top posterior wing edge (153), and an opposing bottom posterior wing edge (154), wherein the barrier posterior wing (150) comprises a shape of an isosceles trapezoid having the top posterior wing edge (153) as the longest edge, wherein the top posterior wing edge (153) is parallel to the bottom posterior wing edge (154), wherein the barrier posterior wing (150) comprises a first posterior wing side (1151) and an opposing second posterior wing side (1152) which taper toward sides in a form of an arc;

wherein a length (2154) of the bottom posterior wing edge (154) is less than a length (2153) of the top posterior wing edge (153); wherein a height (2151) of the first posterior wing side (1151) is less than a height (2141) of a first anterior wing side (1141) and a height (2152) of the second posterior wing side (1152) is less than a height (2142) of a second anterior wing side side (1142); wherein a first corner (1153) is rounded where the first posterior wing side (1151) intersects the bottom posterior wing edge (154), wherein a second corner (1154) is rounded where the second posterior wing side (1152) intersects the bottom posterior wing edge (154);

wherein the top anterior wing edge (143) is continually attached and foldably disposed on the top posterior wing edge (153), wherein the barrier forms a cross-section of a "V" in a sagittal plane, wherein the barrier (130) comprises a wax coating (160) on the front anterior wing surface (141) and the rear posterior wing surface (152);

(c) inserting the barrier (130) into a mouth (116) of a user over a set of bottom teeth (110), wherein the rear anterior wing surface (142) interfaces with a set of bottom teeth front surface (111), wherein the front posterior wing surface (151) interfaces with a set of bottom teeth rear surface (112), wherein the bottom anterior wing edge (144) interfaces with an intersection of a bottom front gum surface (114) and a cheek inside surface (117), wherein an inside surface of an intersection of the top anterior wing edge (143) and the top posterior wing edge (153) interfaces with a set of bottom teeth top edge (113); and (d) inserting the chewing tobacco (120) into the mouth (116) of the user, wherein the chewing tobacco (120) is placed between the front anterior wing surface (141) and the cheek inside surface (117) for use.

4. A chewing tobacco protective barrier system (100) for providing a protective barrier between a portion of chewing tobacco and a gum surface of a user, wherein the system (100) consists of:

(a) a portion of chewing tobacco (120); and (b) a barrier (130) having a planar barrier anterior wing (140) and a planar barrier posterior wing (150), wherein the barrier covers only front lower teeth of the user, wherein the barrier anterior wing (140) consists of a front anterior wing surface (141), a rear anterior wing surface (142), a top anterior wing edge (143), and an opposing bottom anterior wing edge (144), wherein the barrier anterior wing (140) consists of a shape of a rectangle having the top anterior wing edge (143) and the bottom anterior wing edge (144) as the longest edges, wherein the top anterior wing edge (143) and the bottom anterior wing edge (144) are parallel to one another, wherein the barrier posterior wing (150) consists of a front posterior wing surface (151), a rear posterior wing surface (152), a top posterior wing edge (153), and an opposing bottom posterior wing edge (154), wherein the barrier posterior wing (150) consists of a shape of an isosceles trapezoid having the top posterior wing edge (153) as the longest edge, wherein the top posterior wing edge (153) is parallel to the bottom posterior wing edge (154), wherein the barrier posterior wing (150) consists of a first posterior wing side (1151) and an opposing second posterior wing side (1152) which taper toward sides in a form of an arc; wherein a length (2154) of the bottom posterior wing edge (154) is less than a length (2153) of the top posterior wing edge (153); wherein a height (2151) of the first posterior wing side (1151) is less than a height (2141) of a first anterior wing side (1141) and a height (2152) of the second posterior wing side (1152) is less than a height (2142) of a second anterior wing side side (1142); wherein a first corner (1153) is rounded where the first posterior wing side (1151) intersects the bottom posterior wing edge (154), wherein a second corner (1154) is rounded where the second posterior wing side (1152) intersects the bottom posterior wing edge (154);

wherein the top anterior wing edge (143) is continually attached and foldably disposed on the top posterior wing edge (153), wherein the barrier forms a cross-section of a "V" in a sagittal plane, wherein the barrier (130) consists of a wax coating (160) on the front anterior wing surface (141) and the rear posterior wing surface (152).

* * * * *